US008316852B2

(12) United States Patent
Pouteau et al.

(10) Patent No.: US 8,316,852 B2
(45) Date of Patent: Nov. 27, 2012

(54) DEVICE FOR EXTRACTING PARTICLES FROM EXHALED BREATH

(75) Inventors: Patrick Pouteau, Meylan (FR); Jean Luc Achard, Grenoble (FR)

(73) Assignees: Commissariat a l'Energie Atomique, Paris (FR); CNRS, Paris (FR)

( * ) Notice: Subject to any disclaimer, the term of this patent is extended or adjusted under 35 U.S.C. 154(b) by 606 days.

(21) Appl. No.: 12/421,940

(22) Filed: Apr. 10, 2009

(65) Prior Publication Data

US 2010/0000540 A1 Jan. 7, 2010

(30) Foreign Application Priority Data

Apr. 11, 2008 (FR) ..... 08 02013

(51) Int. Cl.

| | |
|---|---|
| ***A62B 7/10*** | (2006.01) |
| ***A62B 23/02*** | (2006.01) |
| ***B03C 3/00*** | (2006.01) |
| ***B03C 3/16*** | (2006.01) |

(52) U.S. Cl. ..... 128/205.27; 95/57; 95/58; 95/59; 95/60; 95/62; 95/71; 95/73; 95/79

(58) Field of Classification Search ..... None
See application file for complete search history.

(56) References Cited

U.S. PATENT DOCUMENTS

| | | | | |
|---|---|---|---|---|
| 3,755,991 | A * | 9/1973 | Steuernagel | 96/35 |
| 4,468,420 | A * | 8/1984 | Kawahara et al. | 427/397.7 |
| 4,604,112 | A * | 8/1986 | Ciliberti et al. | 96/43 |
| 4,670,026 | A * | 6/1987 | Hoenig | 95/73 |
| 5,364,457 | A | 11/1994 | Cameron | |
| 5,837,035 | A | 11/1998 | Braun et al. | |
| 6,773,489 | B2 * | 8/2004 | Dunn | 95/78 |
| 2004/0127808 | A1 * | 7/2004 | Vaughan et al. | 600/532 |
| 2005/0137491 | A1 * | 6/2005 | Paz et al. | 600/543 |

FOREIGN PATENT DOCUMENTS

| | | | |
|---|---|---|---|
| DE | 44 00 420 | A1 | 7/1995 |
| DE | 197 55 681 | A1 | 6/1999 |
| WO | WO 2006/004490 | A1 | 1/2006 |
| WO | WO 2007/012447 | A1 | 2/2007 |
| WO | WO 2007/131981 | A1 | 11/2007 |

OTHER PUBLICATIONS

Chen et al. A microfluidic system for saliva-based detection of infectious Diseases. Ann. N.Y. Acad. Sci. 2007, vol. 1098, p. 429-436.*
French Preliminary Search Report of FR 08/02013 (Dec. 10, 2008).

* cited by examiner

*Primary Examiner* — Louise Humphrey
(74) *Attorney, Agent, or Firm* — Millen, White, Zelano & Branigan, P.C.

(57) ABSTRACT

Device for extracting particles from exhaled breath, comprising a cooling system (16) for creating droplets by condensation of the water vapor contained in the exhaled breath; a droplet recovery unit (7) provided with a side wall (2) having a grid form and converging towards an outlet opening (9), allowing the droplets attracted towards said side wall (2) to flow along the latter towards the outlet opening (9); and a discharge electrode (1) mounted inside the droplet recovery unit (7), said side wall (2) of said droplet recovery unit (7) defining a counter electrode to said discharge electrode (1) in order to attract droplet-collecting particles carried by exhaled breath towards said side wall (2).

17 Claims, 4 Drawing Sheets

DEVICE FOR EXTRACTING PARTICLES FROM EXHALED BREATH

Figure 1:
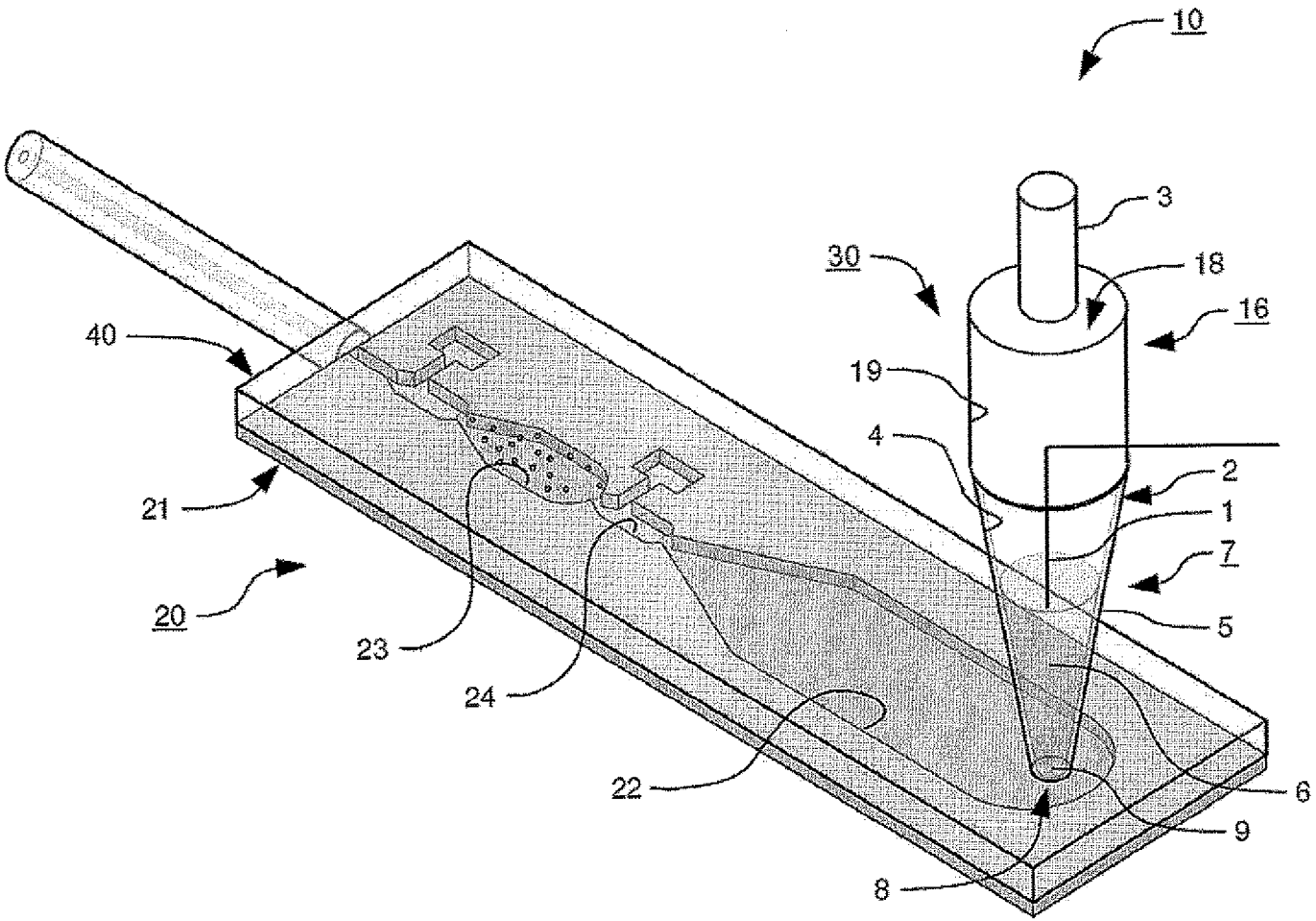

The present invention relates to a device for extracting particles from exhaled breath, and more particularly an electrostatic precipitator for the electrostatic collection of particles carried by exhaled breath.

An electrostatic precipitator (ESP) is a device designed to extract particles from a gas, such as air, using the electrostatic forces produced by an electric field through which these particles pass. The electric field, which is high (several tens of kVs per cm) and non-uniform, is induced by two electrodes. In such an electrostatic precipitator, an electric discharge is created within a pocket of less than a millimeter of ionized gas surrounding one of the electrodes, typically in the form of a point or wire, taken to a high negative or positive potential, a phenomenon called corona effect. The pocket of gas is spherical in the case of a point, and cylindrical in the case of a wire. Originating from this pocket, a flow of ions, called an ionic wind, sweeps the majority of the inter-electrode space. It covers the particles which are then charged. Sensitive to Coulomb forces, they are carried onto the cylindrical or plane counter electrode, which is earthed.

The effectiveness of an electrostatic precipitator is remarkable for all sizes of particles having a minimum size generally less than one micron. Apparatuses operating according to this principle are commercially available (for example from United Air Specialists, Inc.). Their advantages are compactness and a yield of approximately 1 for particles greater than a micron. The main drawback of these systems is the poor yield as regards the collection of submicronic particles.

In order to improve the yield of the electrostatic precipitators in the collection of submicronic particles, certain electrostatic precipitators mix the air containing the particles to be collected beforehand with steam introduced either in the form of droplets, or in the form of dry steam, in a unit upstream of the collection unit. The first case is that of water spray cleaners in which the droplets collect the particles. This type of electrostatic precipitator is commercially available, such as for example from Wheelabrator Air Pollution Control Inc. The capture of the particles results from the fact that they are displaced at the speed of the gas whereas the droplets have a speed relative to that of the gas, which can be controlled by different mechanisms, such as for example gravity, inertia and turbulence. In the second case, a collection mechanism linked to nucleation is added to the preceding collection mechanisms. If the temperature of the injected steam in the ionic wind zone is reduced sufficiently below the vapour saturation temperature, then the steam is condensed around the particles which behave like nucleation sites. The size of the droplets which are capable of transporting small particles is thus increased by condensation and the small particles are thus made more sensitive to the electric field. In both cases, although allowing the collection of small particles with a satisfactory yield, these electrostatic precipitators are intended for industrial use and in the first case may require very large quantities of water (several tens of litres per hour). They are not therefore suitable for portable applications.

More generally, due to their respective sizes, the electrostatic precipitators described above are not suitable for a use allowing an electrostatic collection of particles carried by exhaled breath in a portable microsystem.

The purpose of the present invention is to propose a device compatible with a portable use and allowing the extraction of particles from exhaled breath whilst having a reduced energy consumption. More particularly, the purpose of this invention is to propose a device for the electrostatic collection of pathogens carried by exhaled breath for subsequent analysis.

This purpose is achieved by a system for the analysis of particles extracted from exhaled breath, by a device for extracting particles from exhaled breath, and by an electrostatic precipitator for the electrostatic collection of particles carried by exhaled breath.

More particularly, this purpose is achieved by a device for extracting particles from exhaled breath, comprising a cooling system for creating droplets by condensation of the water vapour contained in the exhaled breath, a droplet recovery unit provided with a side wall in the form of a grid and converging towards an outlet opening, allowing the droplets attracted towards said side wall to flow along the latter towards the outlet opening, and a discharge electrode mounted inside the droplet recovery unit, said side wall of said droplet recovery unit defining a counter electrode to said discharge electrode in order to attract droplets collecting particles carried by exhaled breath towards said side wall.

Thus, a device allowing the extraction of particles from exhaled breath compatible with a portable use while having reduced energy consumption can be produced.

According to a preferred embodiment, the side wall of the droplet recovery unit comprises a plurality of conductive strips. The conductive strips converge towards the outlet opening and are preferably made of metal. Preferably, the conductive strips are spaced apart from each other in order to achieve the grid function.

The grid form allows the exhaled breath to leave the droplet recovery unit freely. Thus the exhaled breath can freely leave said droplet recovery unit without interfering with the process of collecting the droplets capturing particles carried by exhaled breath.

According to a preferred embodiment, said droplet recovery unit is made in the shape of a cone having a point comprising said outlet opening. The conductive strips follow the generators of the cone defining the droplet recovery unit. In other words, the conductive strips are supported downstream by the point of the cone and upstream by the base of the cone.

The cone shape advantageously allows the adaptation of the droplet recovery unit for use in a portable system.

The discharge electrode can be produced as a point or a wire. The inside of the side wall of the droplet recovery unit is preferably rendered hydrophilic by a surface treatment. This treatment can be a silicon oxide deposit. The inside of the side wall of the droplet recovery unit can also be grooved. Its outside is preferably rendered hydrophobic by a surface treatment.

Thus, the flow of the droplets collecting the particles carried by exhaled breath along the side wall of the droplet recovery unit towards the outlet opening of the latter is improved.

The cooling system preferably comprises a chamber having an inside wall, said inside wall being rendered hydrophobic by a surface treatment. Said droplet recovery unit is connected downstream of this cooling system.

Thus, the flow of the droplets created by the condensation of the water vapour contained in the exhaled breath along the inside wall of said chamber of the cooling system towards the side wall of the droplet recovery unit is improved.

According to a preferred embodiment, said droplet recovery unit is connected to a fluidic microsystem for analysis of the particles collected using the droplets which have flowed along the side wall of said droplet recovery unit towards its outlet opening. Preferably, the particles collected are pathogens.

Thus, pathogens carried by exhaled breath can be rapidly and efficiently collected and analyzed by a portable system.

The purpose of the present invention is also achieved by a system for the analysis of particles extracted from exhaled breath, comprising a device for collecting particles from exhaled breath and a fluidic microsystem for analysis of the particles collected. The device for collecting particles from exhaled breath comprises a cooling system for creating droplets by condensation of the water vapour contained in the exhaled breath; a droplet recovery unit provided with a side wall having a grid form and converging towards an outlet opening allowing the droplets attracted towards said side wall to flow along the latter towards the outlet opening; and a discharge electrode mounted inside the droplet recovery unit, said side wall of said droplet recovery unit defining a counter electrode to said discharge electrode for attracting droplets collecting particles carried by exhaled breath towards said side wall. The fluidic microsystem for analysis of the particles collected is connected to said device for collecting the particles from exhaled breath at said outlet opening.

The purpose of the present invention is also achieved by an electrostatic precipitator for the electrostatic collection of particles carried by exhaled breath, comprising a droplet recovery unit provided with a side wall having a grid form and converging towards an outlet opening allowing the droplets attracted towards said side wall to flow along the latter, towards the outlet opening; and a discharge electrode mounted inside the droplet recovery unit, said side wall of said droplet recovery unit defining a counter electrode to said discharge electrode for attracting droplets collecting particles carried by exhaled breath towards said side wall.

Figure 2:
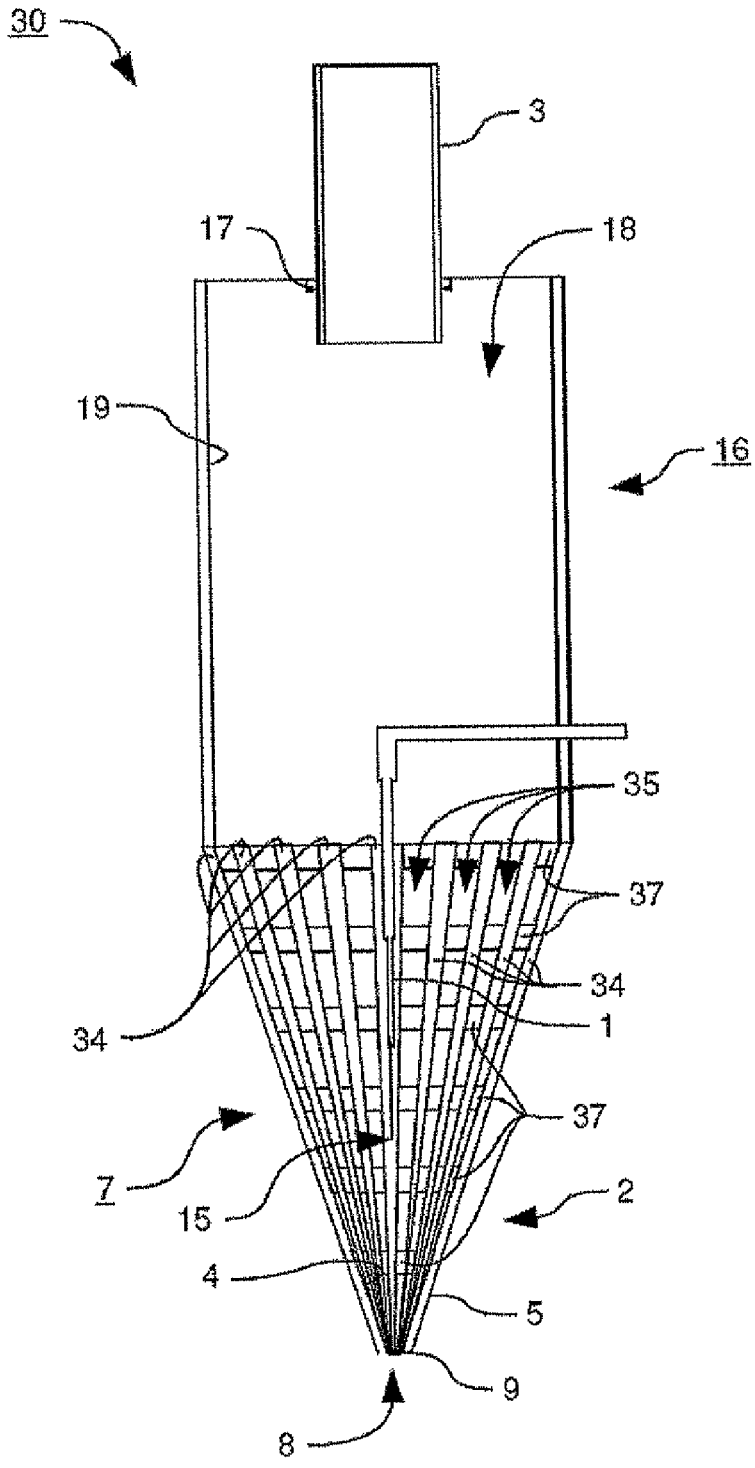
Figure 3:
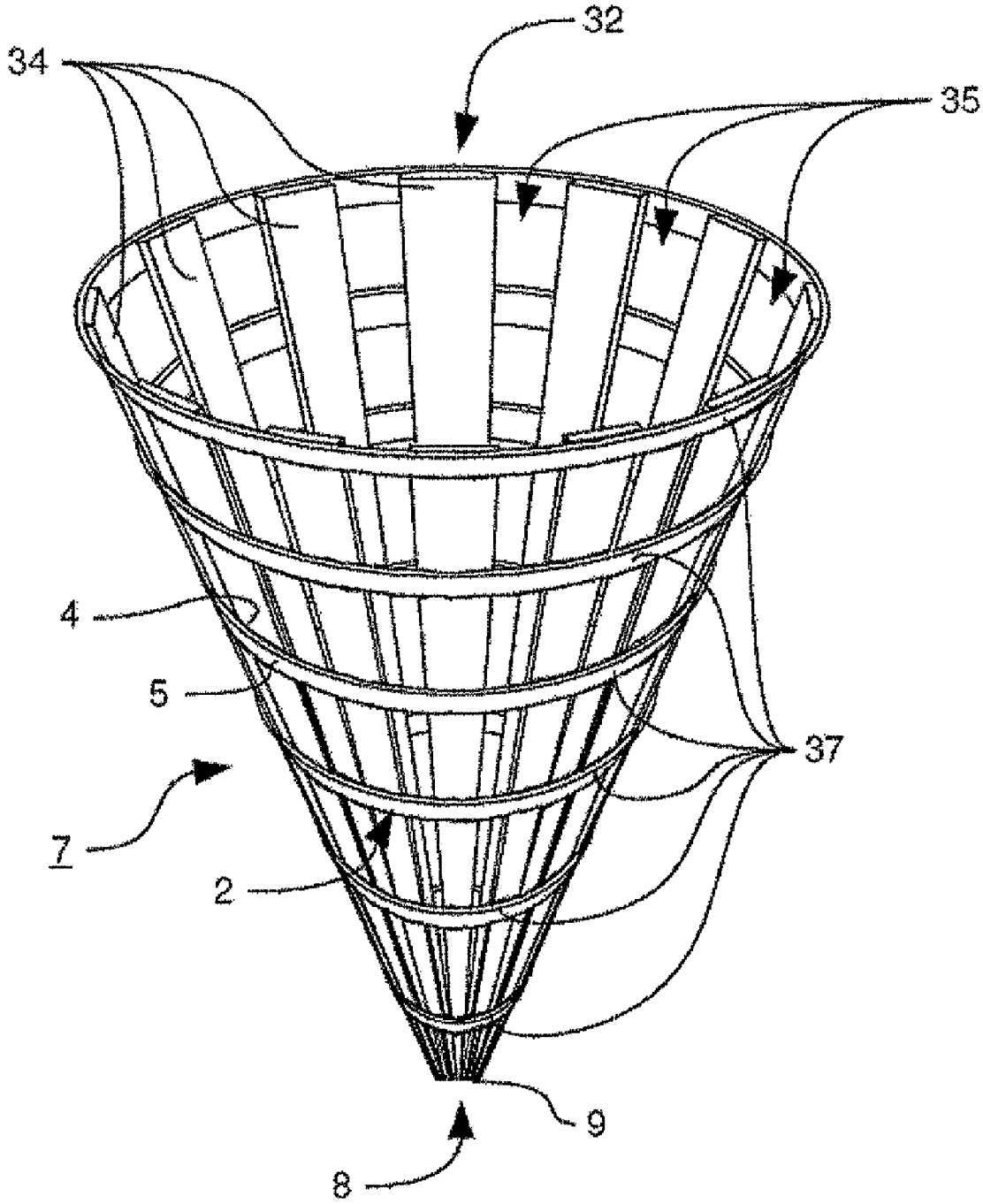
Figure 4:
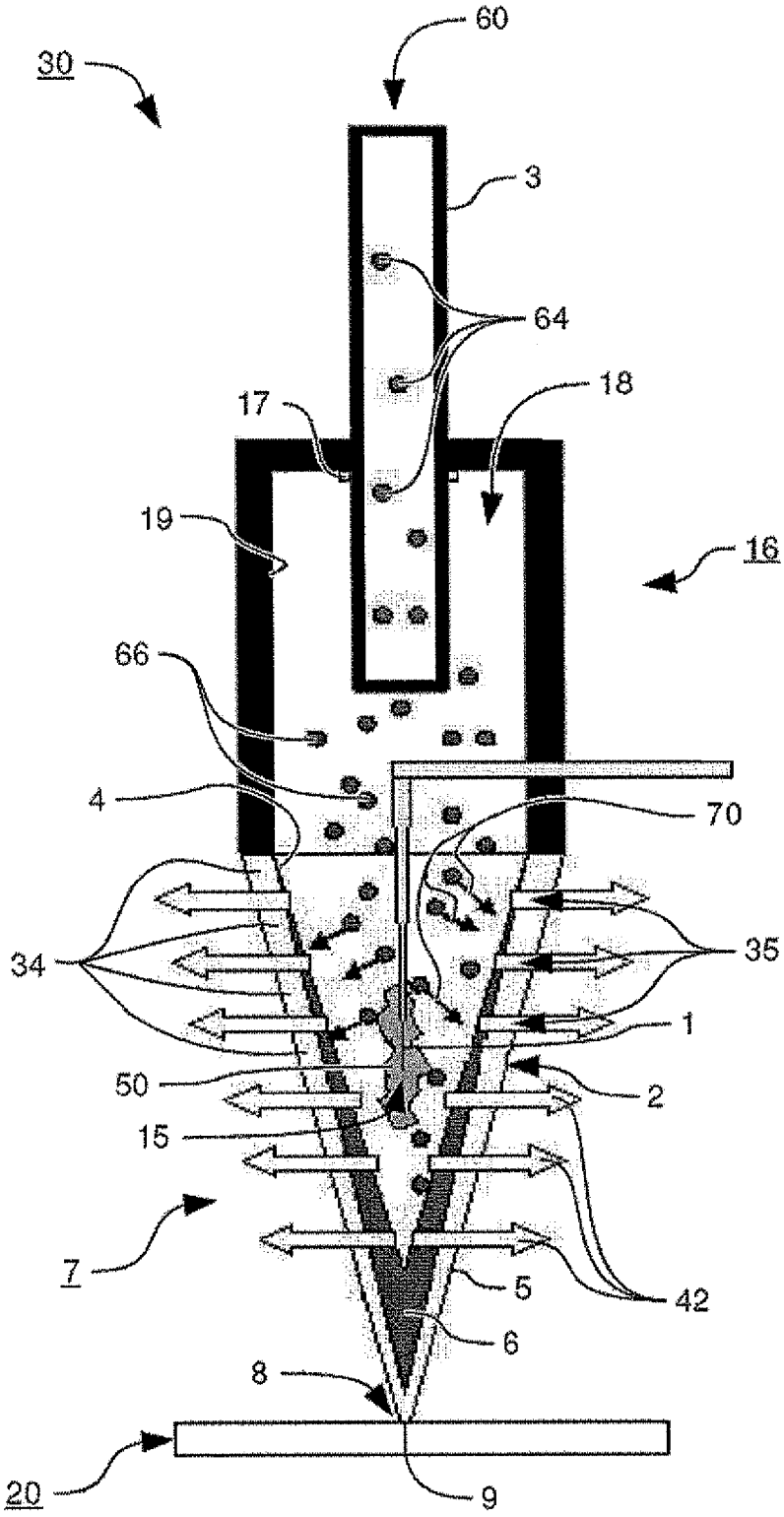

The embodiment details as well as the advantages of the device and the electrostatic precipitator according to the invention will become apparent from the following detailed description of an embodiment given by way of example and illustrated by the attached drawings which show diagrammatically:

FIG. 1 a perspective view of a system for the analysis of particles extracted from exhaled breath according to the present invention, FIG. 2 an enlarged cross-section view of an electrostatic precipitator for the electrostatic collection of particles carried by exhaled breath according to the present invention, FIG. 3 an enlarged perspective view of the cone of the electrostatic precipitator of FIG. 2, and FIG. 4 an enlarged cross-section view of the electrostatic precipitator of FIG. 2 illustrating its operating principle according to the present invention.

In the following detailed description of the attached drawings, the identical elements are denoted by identical identification references. Generally, these elements and their functionalities are described only once for reasons of brevity in order to avoid repetitions. Terms such as "left", "right", "at the top", "at the bottom", "upper", "lower", "in front" or "behind" may be used in the description of the attached drawings. These terms generally refer to a particular position of a component in an associated figure, which can vary from one figure to another.

FIG. 1 illustrates by way of example a system 10 for the analysis of particles extracted from exhaled breath according to the present invention. Exhaled breath is normally loaded with water vapour and can contain particles including pathogens such as viruses, bacteria, cells, antibodies, antigens, nucleic acids etc., which it would be desirable to analyze.

According to a preferred embodiment, the system 10 comprises a device 30 for collecting particles from exhaled breath and a fluidic microsystem for analysis of the particles collected 20. The device 30 comprises a cooling system 16 and a droplet recovery unit 7 defining an electrostatic precipitator. The latter are shown in FIG. 1 as being transparent, for the purpose of illustration.

The cooling system 16 comprises a chamber 18 having an inside wall 19 which is in this case, for the purpose of illustration, cylindrical in shape. According to a preferred embodiment, the cooling system 16 is positioned upstream of the droplet recovery unit 7 and connected to the latter by a watertight connection. The cooling system 16 is capable of cooling the water vapour contained in the exhaled breath in order to obtain droplets by the condensation of the water vapour. For the purpose of illustration, the exhaled breath is conveyed towards the chamber 18 through an end piece 3.

Nevertheless, it should be noted that the particular position and embodiment of the cooling system 16 are not limited to those illustrated in FIG. 1, whilst the latter makes it possible to cool the water vapour contained in the exhaled breath in order to obtain droplets by condensation. For example, the cooling system 16 and the droplet recovery unit 7 can be combined such that the water vapour contained in the exhaled breath is only cooled down as from its arrival in the droplet recovery unit 7. Alternatively, the droplet recovery unit 7 can be cooled down itself, for example by contact and conduction with the cooling system 16. Thus, different embodiments can be envisaged and generally considered.

As shown in FIG. 1, the droplet recovery unit 7 has a side wall 2 which preferably defines a shape converging towards an outlet opening 9 provided at its lower point 8. The side wall 2 has an inside 4 and an outside 5. As described below with reference to FIGS. 2 to 4, the droplet recovery unit 7 is advantageously in the form of a grid.

Inside the droplet recovery unit 7 a discharge electrode 1 is mounted which is capable of creating a flow of ions from a pocket of ionized gas surrounding the discharge electrode 1. In order to allow the creation of such a flow of ions, the side wall 2 defines a counter electrode to the discharge electrode 1. Thus, droplets capable of collecting particles carried by exhaled breath are carried away by the flow of ions from the location of the discharge electrode 1 towards the side wall 2 of the droplet recovery unit 7. Along their trajectory, these droplets capture particles to be collected and carry them towards the side wall 2, or the droplets with the captured particles form a liquid film 6 which flows along the side wall 2 towards the outlet opening 9 and through the latter into the microsystem 20.

According to a preferred embodiment, the outlet opening 9 is fitted to a respective inlet of the microsystem 20. The latter is connected to the device 30, for example by gluing, in order to recover the collected particles.

The microsystem 20 comprises a silicon substrate 21 having fluid chambers and channels, such as the chambers 22, 23 and the channel 24. The latter can be produced by photolithography and standard silicon etching techniques on or in the upper surface of the substrate 21. Depending on the requirement or the protocol for analysis of a respective sample to be collected via the device 30, the fluid chambers 22, 23 and the channel 24 can be provided with a depth of the order of 10 to 500 μm.

The fluidic part of the microsystem 20 is rendered watertight by assembling on top of the substrate 21 a silica wafer 40 pierced with holes serving as inlet-outlet for the microsystem 20. The silica wafer 40 can alternatively be made of glass, plastic or any other material making it possible to render the microsystem 20 watertight. The assembly of the wafer 40 and the substrate 21 can be rendered irreversible by a deposit of adhesive on the substrate 21 around the fluidic parts of the component, i.e. around the chambers 22, 23 and the channel 24. This adhesive deposit is produced for example by adhesive screen printing. A suitable process is described in the patent FR 2 856 047.

Thus, multiple microsystems 20 can be assembled on a single wafer as described above. The assembly having thus been achieved, this wafer can be cut into individual components by cutting with a suitable cutter.

Nevertheless, it should be noted that the production of fluidic microsystems suitable for the analysis of particles collected from exhaled breath is known to a person skilled in the art. Thus, a more detailed description of the microsystem and its operation is omitted for the sake of brevity.

FIG. 2 shows the device 30 for collecting particles from exhaled breath of FIG. 1 in enlarged cross-section view. As is shown in FIG. 2, the chamber 18 of the cooling system 16 is rendered hermetic relative to the end piece 3 by means of a seal 17 and the discharge electrode 1 is a point 15.

Alternatively, the discharge electrode 1 can be produced as a wire, in particular a polarized wire. Such a wire makes it possible to produce a more extensive discharge zone than the point 15, as the corresponding discharge zone would be situated around the whole length of the wire, thus allowing the collection of particles from exhaled breath. By way of example, a discharge voltage of 10 KV could be applied to a wire having a diameter of 50 μm in order to create a suitable discharge zone. This voltage can be increased for a wire with a greater diameter. It can be reduced for a wire with a smaller diameter, for example a wire with a diameter of 10 microns.

According to an embodiment, the wire is made from a mechanically resistant conductive material such as, for example, tungsten. Preferably, the material used can also be welded or soldered, such as for example copper. Such a wire will preferably be positioned parallel to the axis of the droplet recovery unit 7, preferably parallel to its central axis, and fixed in position by support means, said support means being, by way of example, supported against the inside 4 of the side wall 2 and joining the ends of the wire to the latter without however interfering with the flow of the droplets collected. According to an embodiment, three coplanar supports spaced at approximately 60° to each other, thus constituting a star-shaped support, serve as a support means at each end of the wire.

As mentioned above, according to a preferred embodiment the droplet recovery unit 7 of the device 30 is of grid form. Its side wall 2 comprises for example a plurality of conductive strips 34 converging towards the outlet opening 9. The latter are preferably interconnected by struts 37, and spaced apart by gaps 35. The conductive strips 34 define a counter electrode to the discharge electrode 1 and are, preferably, made of metal.

The gaps 35 are represented in an oversized manner in order to clarify their layout. Nevertheless, the layout of the gaps 35 should be such that the droplets carried along towards the side wall 2 can flow towards the outlet opening 9 along the side wall 2 freely and that the exhaled breath, i.e. any non-condensable gas, can leave the droplet recovery unit 7 freely.

FIG. 3 shows the droplet recovery unit 7 of FIG. 1 in enlarged perspective view. The latter clearly shows the grid form of the recovery unit 7 with the conductive strips 34, the gaps 35 and the struts 37. Only one part of the conductive strips 34 and the gaps 35 has been denoted with identification references for the sake of clarity of the representation.

As shown in FIG. 3, the droplet recovery unit 7 is preferably made in the shape of a cone with a base 32 and the point 8 comprising the outlet opening 9. The conical shape of the recovery unit 7 is defined by the generators of the cone supporting the conductive strips 34. In the example illustrated in FIG. 3, the conductive strips 34 represent generators of the cone and are then carried downstream by the point 8 of the cone and upstream by its base 32, i.e. by the downstream part of the cooling system 16 of FIG. 2.

The abovementioned embodiment of the droplet recovery unit 7, and in particular its conical shape, offers the advantage of constituting on its inside 4 a surface which is not arranged parallel to the exhaled breath and thus to the trajectory of the particles conveyed by the latter. This surface as well as the grid shape of the droplet recovery unit 7 then promotes the passage of particles in proximity to at least one of the conductive strips 34, thus making it possible to increase the effectiveness of collection of the droplet recovery unit 7, unlike that of a structure arranged parallel to the trajectory of the particles conveyed by the exhaled breath.

Nevertheless, it should be noted that other embodiments are possible. For example, the conductive strips 34 can be made circular, spiral, in the form of chevrons or another form, provided that the functionality described in the context of the present invention is ensured. Thus, all these different embodiments are considered.

It should be noted that the droplet recovery unit 7 illustrated in FIG. 3 comprises a plurality of struts 37 by way of example. Nevertheless, according to a preferred embodiment the conductive strips 34 are held only by a first strut provided close to the base 32 and a second strut provided close to the point 8 of the droplet recovery unit 7, preferably starting from the lower end of the latter. In other words, the number and the location of the struts 37, which essentially serve to maintain the structure of the cone chosen to produce the recovery unit 7, can be modified without changing the functionality of the droplet recovery unit 7.

In order to produce the droplet recovery unit 7 of FIG. 3 in the shape of a cone, several techniques can be envisaged and considered. For example, a cone of suitable dimensions made of a stamped aluminium alloy can be used. In this cone, lateral evacuation slots defining the gaps 35 as well as the outlet opening 9 at the point 8 of the cone are produced by laser cutting.

FIG. 4 illustrates the operating principle of the device 30 of FIG. 1 according to the present invention. According to a preferred embodiment, exhaled breath 60 is conveyed towards the cooling system 16 through the end piece 3. The exhaled breath 60 is loaded with water vapour and contains particles to be collected 66.

In the cooling system 16, exhaled breath 60 is cooled down in order to obtain droplets of water vapour by condensation. These droplets are carried towards the side wall 2 of the droplet recovery unit 7 by a flow of ions generated from a pocket of ionized gas 50 surrounding the point 15 of the discharge electrode 1. During their trajectory, denoted for the purpose of illustration by arrows 70, the droplets obtained capture particles 66 and carry them towards the side wall 2.

On arriving at the side wall 2, the droplets form a liquid film 6 there which flows along the side wall 2 towards the outlet opening 9. The operation of an electrostatic precipitator such as that defined by the device 30 being generally known to a person skilled in the art, a more detailed description is omitted here.

In order to improve the operation of the device 30, the inside 4 of the side wall 2 of the droplet recovery unit 7 can be rendered hydrophilic by a surface treatment, for example by a silicon oxide ($SiO_2$) deposit. The inside 4 can also be structured by grooving oriented in the direction of flow of the droplets, the grooving helping to channel the flow. Moreover, its outside 5 can be rendered hydrophobic by a surface treatment. As regards the cooling system 16, the inside wall 19 of its chamber 18 can also be rendered hydrophobic by a surface treatment.

Although a particular embodiment is described above, multiple variations can be made to the fastener according to the invention without altering its functionality. Consequently, all these variations are also envisaged and generally considered.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications, cited herein and of corresponding French application No. 08/02013, filed Apr. 11, 2008, are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A portable device for extracting particles from exhaled breath, comprising:

(1). A cooling system for creating droplets by condensation of water vapour contained in the exhaled breath;

(2). A droplet recovery unit in the shape of a cone having a point comprising an outlet opening, said droplet recovery unit comprising:

a. A discharge electrode mounted inside the droplet recovery unit; and b. A side wall having a counter electrode grid converging towards said outlet opening, comprising a plurality of conductive strips defining the cone shape of the droplet recovery unit, wherein said side wall is suitable for attracting particles in the droplets that are attracted towards said side wall to flow along the side wall towards the outlet opening.

2. The device of claim 1, wherein the conductive strips are made of metal.

3. The device of claim 1, wherein the conductive strips are spaced apart from each other in order to allow the exhaled breath to leave the droplet recovery unit freely.

4. The device of claim 1, wherein the conductive strips are supported downstream by the point of the cone and upstream by the base of the cone.

5. The device of claim 1, wherein the discharge electrode is a point or a wire.

6. The device of claim 1, wherein the side wall has an inside which is rendered hydrophilic by a surface treatment.

7. The device of claim 6, wherein the treatment is a silicon oxide deposit.

8. The device of claim 1, wherein the side wall has an inside that is grooved.

9. The device of claim 1, wherein the side wall has an outside that is rendered hydrophobic by a surface treatment.

10. The device of claim 1, wherein the cooling system comprises a chamber having an inside wall, said inside wall being rendered hydrophobic by a surface treatment.

11. The device of claim 1, wherein said droplet recovery unit (7) is connected downstream of the cooling system.

12. The device of claim 1, wherein said droplet recovery unit is connected to a fluidic microsystem, comprising a silicon substrate having fluid chambers and channels suitable for analysis of the particles collected from the outlet opening of the droplet recovery unit.

13. The device of claim 1, wherein the particles are pathogens.

14. A system for the analysis of particles extracted from exhaled breath, comprising:

a device according to claim 1; and a fluidic microsystem comprising a silicon substrate having fluid chambers and channels suitable for analysis of the collected particles, said microsystem being connected to said device in order to collect the particles from exhaled breath at said outlet opening.

15. A process for producing the system of claim 14, comprising connecting a device of claim 1 to a fluidic microsystem.

16. A method for collecting particles from exhaled breath comprising: collecting particles from exhaled breath with the system of claim 14.

17. A portable device for extracting particles from exhaled breath, consisting essentially of:

1. A cooling system for creating droplets by condensation of water vapour contained in the exhaled breath;

2. A droplet recovery unit in the shape of a cone having a point comprising an outlet opening, comprising:

a. A discharge electrode mounted inside the droplet recovery unit; and b. A side wall having a counter electrode grid converging towards an outlet opening comprising a plurality of conductive strips defining the cone shape of the droplet recovery unit, wherein said side wall is suitable for attracting particles in the droplets that are attracted towards said side wall to flow along the side wall towards the outlet opening.

* * * * *